US009682325B2

(12) United States Patent
Dufault Rindfleisch et al.

(10) Patent No.: US 9,682,325 B2
(45) Date of Patent: Jun. 20, 2017

(54) CLIP-ON ATTACHMENT THAT PROVIDES BACK SUPPORT FOR CHILDREN WHEN ON A SWING THAT DOES NOT HAVE BACK SUPPORT

(71) Applicant: SwingSafe, Inc., Gladstone, NJ (US)

(72) Inventors: Stephanie Ann Dufault Rindfleisch, Westford, MA (US); Braun Carl Kiess, Far Hills, NJ (US)

(73) Assignee: SwingSafe, Inc., Gladstone, NJ (US)

( * ) Notice: Subject to any disclaimer, the term of this patent is extended or adjusted under 35 U.S.C. 154(b) by 0 days.

(21) Appl. No.: 14/706,622

(22) Filed: May 7, 2015

(65) Prior Publication Data

US 2016/0095447 A1 Apr. 7, 2016

Related U.S. Application Data

(60) Provisional application No. 61/989,606, filed on May 7, 2014.

(51) Int. Cl.
*A47C 7/42* (2006.01)
*A63G 9/00* (2006.01)

(52) U.S. Cl.
CPC . *A63G 9/00* (2013.01); *A47C 7/42* (2013.01)

(58) Field of Classification Search
CPC .. A47C 1/16; A47C 7/425; A47C 7/42; A63G 9/00; A47D 1/10
USPC ..... 297/230.1, 485, 256.17, 255, 273, 352, 297/465; 472/118
See application file for complete search history.

(56) References Cited

U.S. PATENT DOCUMENTS

| | | | | |
|---|---|---|---|---|
| 1,837,983 | A * | 12/1931 | Moran | A41B 13/10 2/49.4 |
| 4,702,523 | A * | 10/1987 | Schrader | A47D 15/006 297/465 |
| D316,135 | S | 4/1991 | Barber, Jr. | |
| 5,119,767 | A * | 6/1992 | Jimenez | B60R 22/105 119/770 |
| 5,533,934 | A | 7/1996 | Miller | |
| 5,553,915 | A * | 9/1996 | Stamatakis | B62J 1/162 297/183.9 |
| 5,676,426 | A | 10/1997 | Herring | |
| 5,839,965 | A | 11/1998 | Mullins | |
| 5,890,769 | A * | 4/1999 | Fairbanks | A47D 15/006 297/467 |
| 6,095,613 | A | 8/2000 | Ostrander et al. | |
| 6,474,736 | B1 | 11/2002 | Brown | |
| 7,837,568 | B1 * | 11/2010 | Glaze | A63G 9/00 472/118 |
| 8,992,337 | B1 | 3/2015 | Koziol et al. | |
| 2003/0040372 | A1 * | 2/2003 | McNutt | A47D 13/105 472/118 |
| 2006/0220437 | A1 * | 10/2006 | Merson | A63G 9/00 297/467 |
| 2007/0243939 | A1 * | 10/2007 | Mead | A47D 13/086 472/118 |

(Continued)

FOREIGN PATENT DOCUMENTS

GB 2465066 5/2010

*Primary Examiner* — Milton Nelson, Jr.
(74) *Attorney, Agent, or Firm* — Davidson, Davidson & Kappel, LLC

(57) ABSTRACT

An attachment that provides back support for a child on a swing, where the swing does not already have a back support, is disclosed, as well as a method of using the same.

15 Claims, 8 Drawing Sheets

(56) References Cited

U.S. PATENT DOCUMENTS

2014/0252826 A1* 9/2014 Smith ..... A63G 9/00
297/250.1

* cited by examiner

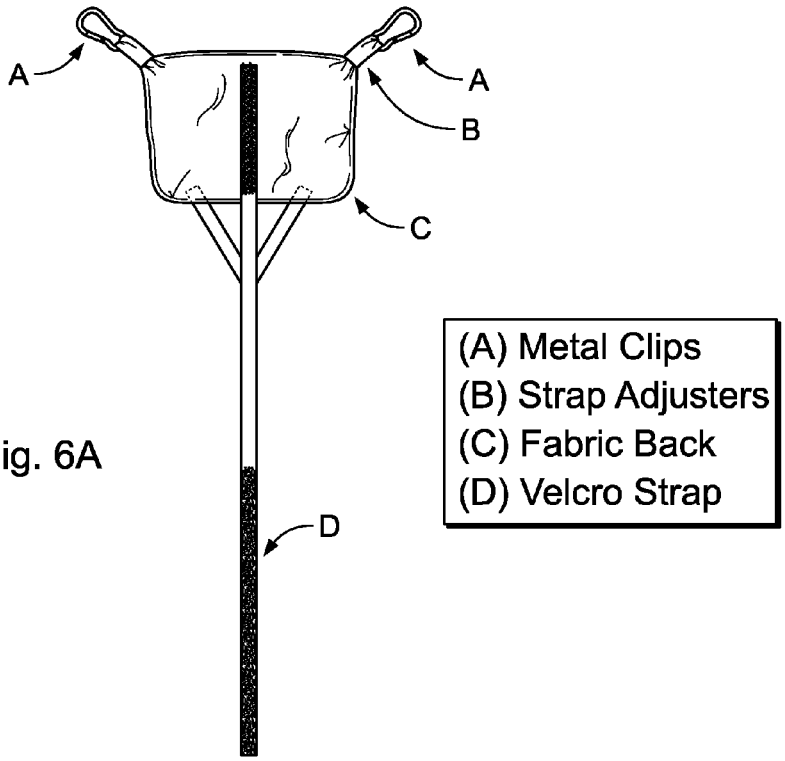
Fig. 6A
Fig. 6B
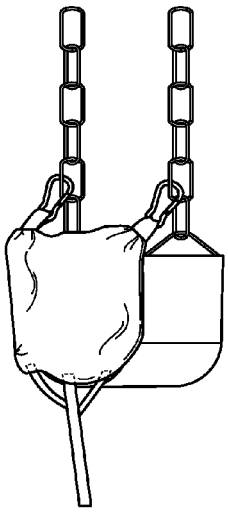
Fig. 6C
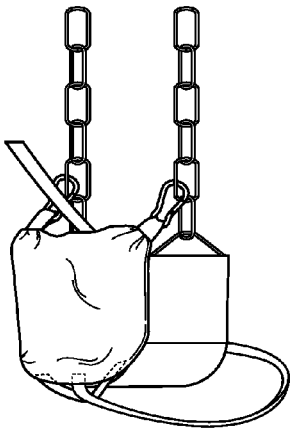
Fig. 6D
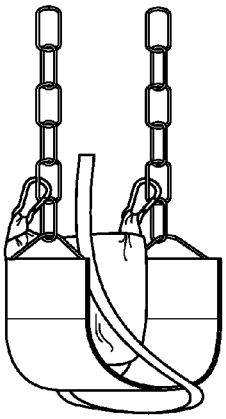

CLIP-ON ATTACHMENT THAT PROVIDES BACK SUPPORT FOR CHILDREN WHEN ON A SWING THAT DOES NOT HAVE BACK SUPPORT

BACKGROUND OF THE INVENTION

As a mother of four including an autistic child, I have seen my children fall backwards off of swings multiple times, since they are falling backwards there is no way for them to brace themselves with their hands so they often hit the back of their heads resulting in injury and fear of the swing. This device provides back support helping prevent the child from falling backwards but does not attach to the child therefore it does not confine the child to the swing.

SUMMARY OF THE INVENTION

The present invention is directed in part to a compact, machine washable, portable child safety device that clips on to a swing and provides the child with back support and helps prevent them from injury caused by falling backwards off the swing. This product is useful for children who are not yet stable on a swing as well as physically challenged children. This device aids in the prevention of injuries from falling off the swing backwards, but does not confine or attach the child to the swing. It is e.g., made of machine washable material and can also be made with material that will withstand weather if the intent is for the device to be left out on a home playground.

The invention is also directed in part to a method of attaching the above mentioned device to a swing that does not have a back support.

The invention is further directed in part to a method of using the device of the present invention.

More particularly, the invention is directed in part to an attachment for a swing that does not have back support, comprising a back support adapted to fit between a pair of playground swing chains to which a swing seat is attached, the back support being planar and made of a fabric material, the back support having a front side, and a back side, and the back support having an upper area comprising a right and left quadrant and a center quadrant, and a lower area comprising a lower left quadrant, a lower right quadrant, and a lower center quadrant; a left adjustable strap having a proximal end attached to a left upper quadrant of the back support, the left adjustable strap having a distal end which has a fastener for attaching the left adjustable strap to a playground swing chain; a right adjustable strap having a proximal end attached to a right upper quadrant of the back support, the right adjustable strap having a distal end which has a fastener for attaching the left adjustable strap to a playground swing chain; a center strap having a first end attached to the back support, the center strap having a second end having a fastener for attaching the second end of the center strap to the back support; the attachment being configured such that in use the left and right adjustable straps are removably attached to respective playground swing chains, and the center strap can be wrapped around the top and then under the swing seat and the second end of the center strap is attached to the back support, such that when in use the back support supports the back of a child seated on the swing seat and the child sits on the center strap, and such that the strap does not attach to the child and allows the child to get off the swing unassisted. In certain preferred embodiments, the back support is lightweight and washable. In certain embodiments, the center strap is comprised of hook and loop tape. In certain embodiments, the back support is a rectangle measuring about 8 inches by about 12 inches. In certain embodiments, the fasteners on the left and right adjustable straps are metal clips, e.g., carabiners. In certain embodiments, the attachment for a swing further comprises a left lower strap attached at a first end to the lower left quadrant of the back support, the left lower strap having a second end attached to the center strap; a right lower strap attached at a first end to the lower right quadrant of the back support, the right lower strap having a second end attached to the center strap at the same location as the attachment of the left lower strap, the right and left lower straps being of equal length and attached to the back support at equal distances from the center strap. In certain embodiments, the fastener on the center strap is Velcro. In certain embodiments, the first end of the center strap comprises a fastener (e.g., Velcro) for attachment of the second end of the center strap thereto.

The invention is also directed in part to a playground swing assembly, comprising a pair of playground swing chains to which a swing seat is attached, a back support adapted to fit between the pair of playground swing chains, the back support being made of a fabric material, the back support having a front side and a back side, and the back support having an upper area comprising a right and left quadrant and a center quadrant, and a lower area comprising a lower left quadrant, a lower right quadrant, and a lower center quadrant; a left adjustable strap having a proximal end attached to a left upper quadrant of the back support, the left adjustable strap having a distal end which has a fastener attaching the left adjustable strap to one of the playground swing chains; a right adjustable strap having a proximal end attached to a right upper quadrant of the back support, the right adjustable strap having a distal end which has a fastener attaching the left adjustable strap to the other playground swing chain; a center strap having a first end attached to the back support, the center strap having a second end having a fastener for attaching the second end of the center strap to the back support; the attachment being configured such that the left and right adjustable straps are removably attached to respective playground swing chains, and the center strap is wrapped around the top of the swing seat and then under the swing seat and the second end of the center strap is attached to the first end of the center strap, and such that when in use the back support supports the back of a child seated on the swing seat and the child sits on the center strap, such that the strap does not attach to the child and allows the child to get off the swing unassisted. In certain preferred embodiments, the attachment further comprises a left lower strap attached at a first end to the lower left quadrant of the back support, the left lower strap having a second end attached to the center strap; and a right lower strap attached at a first end to the lower right quadrant of the back support, the right lower strap having a second end attached to the center strap at the same location as the attachment of the left lower strap, the right and left lower straps being of equal length and attached to the back support at equal distances from the center strap. In certain embodiments, the first end of the center strap comprises a fastener (e.g., Velcro) for attachment of the second end of the center strap thereto.

In other embodiments, the invention is directed to a method of providing back support to a playground swing that does not provide back support, comprising providing an attachment for a playground swing comprising a back support adapted to fit between a pair of playground swing chains to which a swing seat is attached, the back support being made of a fabric material, the back support having a front side and a back side, and the back support having an upper area comprising a right and left quadrant and a center quadrant, and a lower area comprising a lower left quadrant, a lower right quadrant, and a lower center quadrant; a left adjustable strap having a proximal end attached to a left upper quadrant of the back support, the left adjustable strap having a distal end which has a fastener for attaching the left adjustable strap to a playground swing chain; a right adjustable strap having a proximal end attached to a right upper quadrant of the back support, the right adjustable strap having a distal end which has a fastener for attaching the left adjustable strap to a playground swing chain; a center strap having a first end attached to the back support, the center strap having a second end having a fastener for attaching the second end of the center strap to the back support; attaching the left adjustable strap to one of the playground swing chains; attaching the right adjustable strap to the other playground swing chain; wrapping the center strap around the top of the swing seat and then under the swing seat and then attaching the second end of the center strap to the back support, such that when in use the back support supports the back of a child seated on the swing seat and the child sits on the center strap, and such that the strap does not attach to the child and allows the child to get off the swing unassisted. In certain preferred embodiments, the attachment further comprises a left lower strap attached at a first end to the lower left quadrant of the back support, the left lower strap having a second end attached to the center strap; and a right lower strap attached at a first end to the lower right quadrant of the back support, the right lower strap having a second end attached to the center strap at the same location as the attachment of the left lower strap, the right and left lower straps being of equal length and attached to the back support at equal distances from the center strap.

BRIEF DESCRIPTION OF THE DRAWINGS

FIG. 6A is a top view of an embodiment of the attachment for a playground swing.

FIG. 6B is a back view of the attachment for a playground swing.

FIG. 6C is a back view of the attachment for a playground swing wherein the left and right adjustable straps have been attached to corresponding left and right playground swing chains and the center strap has been looped around the playground swing seat.

FIG. 6D is a side view of the attachment for a playground swing.

DETAILED DESCRIPTION OF THE INVENTION

This invention provides back support to a swing that does not provide back support. It is lightweight compact, washable, and can be made using several different types of fabric including fabric intended to withstand elements so it can be left on someone's personal swing. This device helps to prevent children who are not yet balanced from falling backwards off a swing that does not provide back support, as well as disabled children who may be at risk for falling off a swing backwards. The heaviest part of a toddler's body is often their head and when pushed on a swing without back support they often fall backwards. These falls can result in head injury or fear of swings. This product does not attach to the child, allowing the child to get off unassisted if able. This device assists children with learning to pump on their own and be confident they will not fall off the swing backwards. This device aids in the prevention of injury due to the child falling off the swing backwards. There have been several playground safety studies done and head injuries from the swing are more frequent when falling backwards because of the inability to put their hands out in front of them to buffer the fail. Head injures especially to very young children can be life threatening or fatal.

Relationship Between the Components

Figure 1:
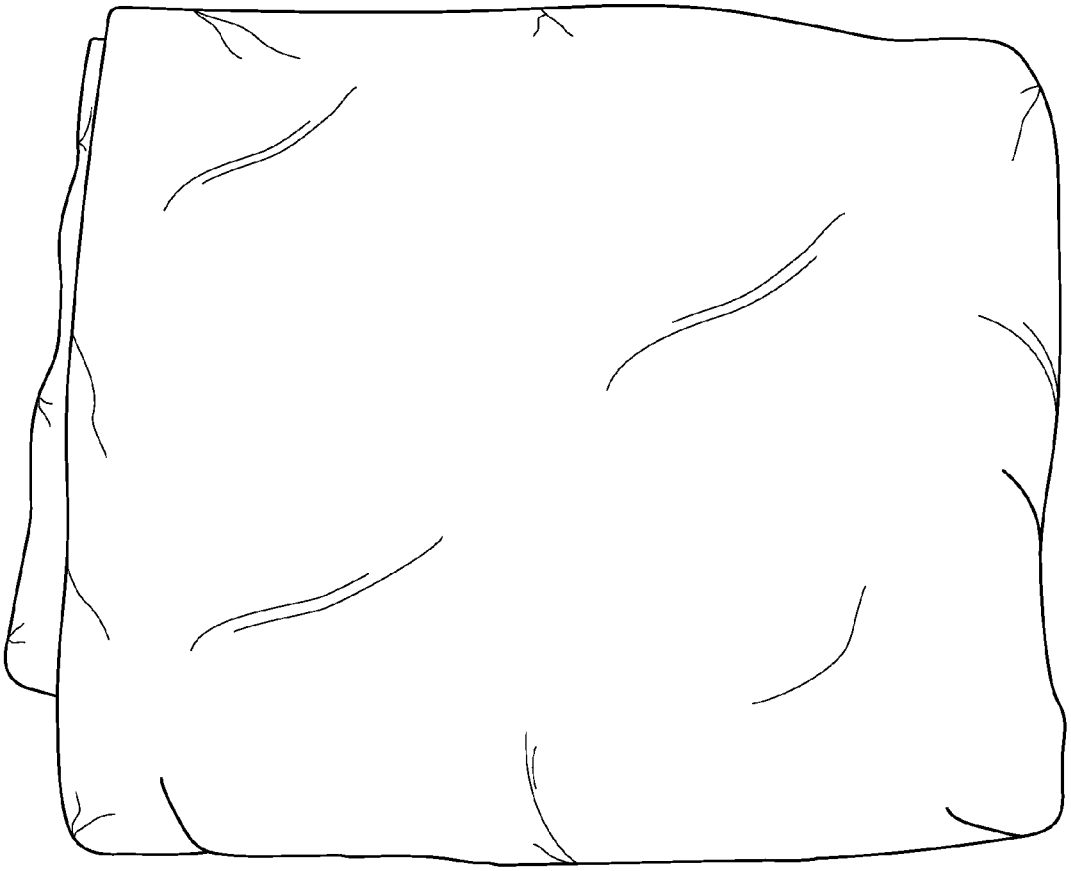
FIG. 1 is a top view of the back support of the attachment for a playground swing wherein the back support comprises, e.g., a machine washable fleece fabric.

FIG. 1 is the fabric back support. Any number of strong fabric types could be used. The fabric used in Example 1 is 2 fleece pieces sewn together but material made to withstand elements could be used in the case that it would likely stay attached to someone's personal swing.

Figure 2:
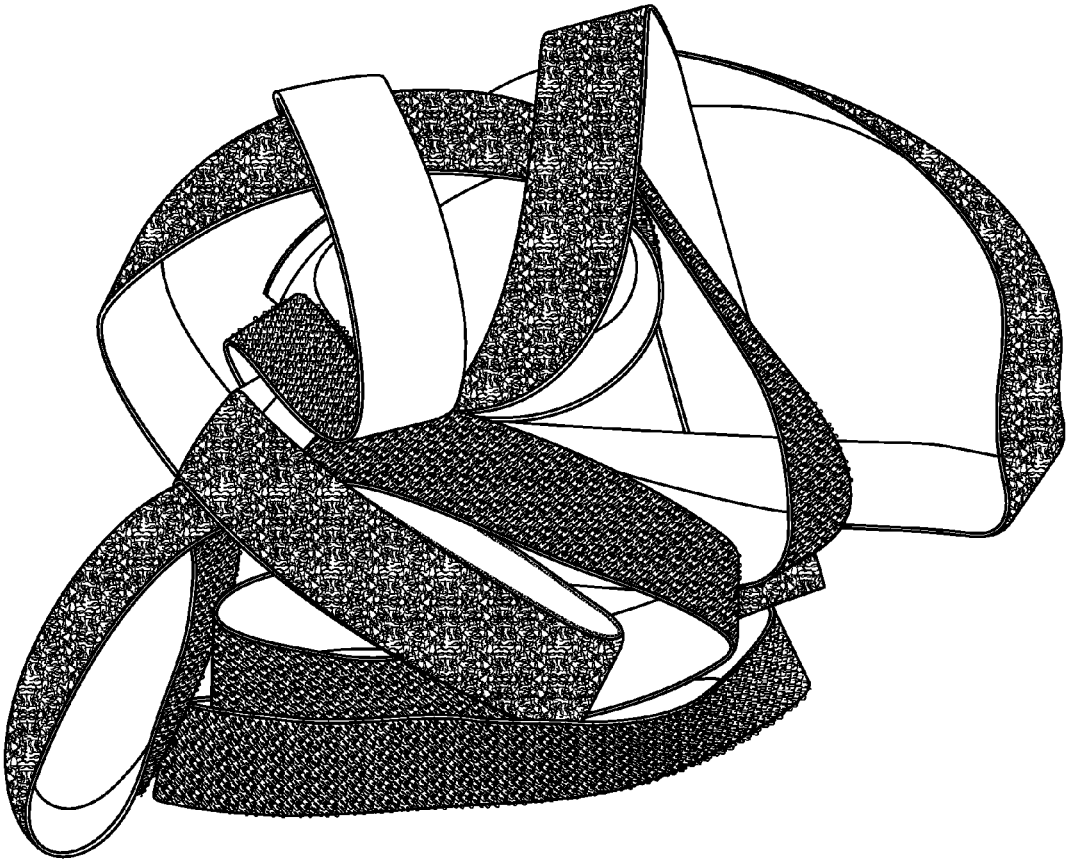
FIG. 2 is a side view of the material that may be used for the straps which are attached to the back support.
Figure 3:
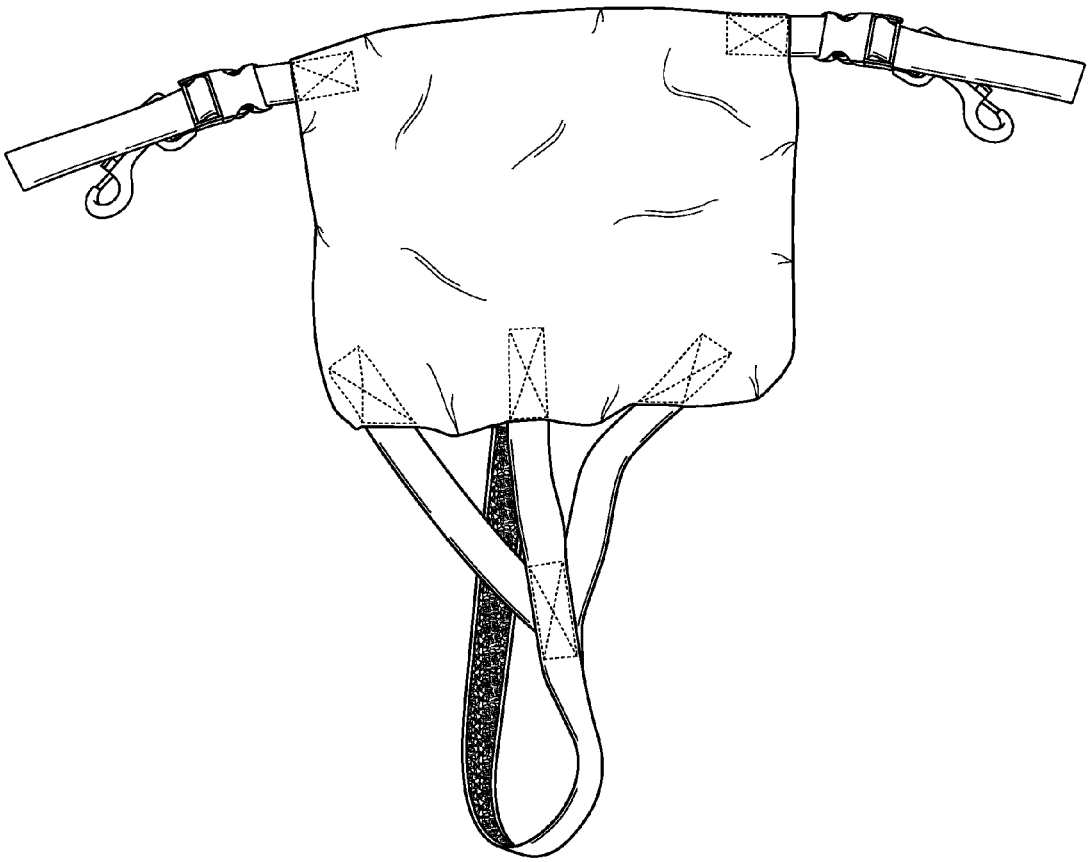
FIG. 3 is a side view of the attachment for a playground swing showing the left and right adjustable straps with fasteners for attaching to playground swing chains, left and right lower straps and a center strap.

FIG. 2 is a depiction of a useful strap material. As shown in FIG. 3, 2 pieces of equal length (i.e., a left lower strap and a right lower strap) are attached on either end of the bottom of the back support fabric and then sewn securely to a much longer piece of strap material (i.e., a center strap) that is sewn on one end to the back support fabric at equal distance between the first (left) and second (right) straps.

Figure 4:
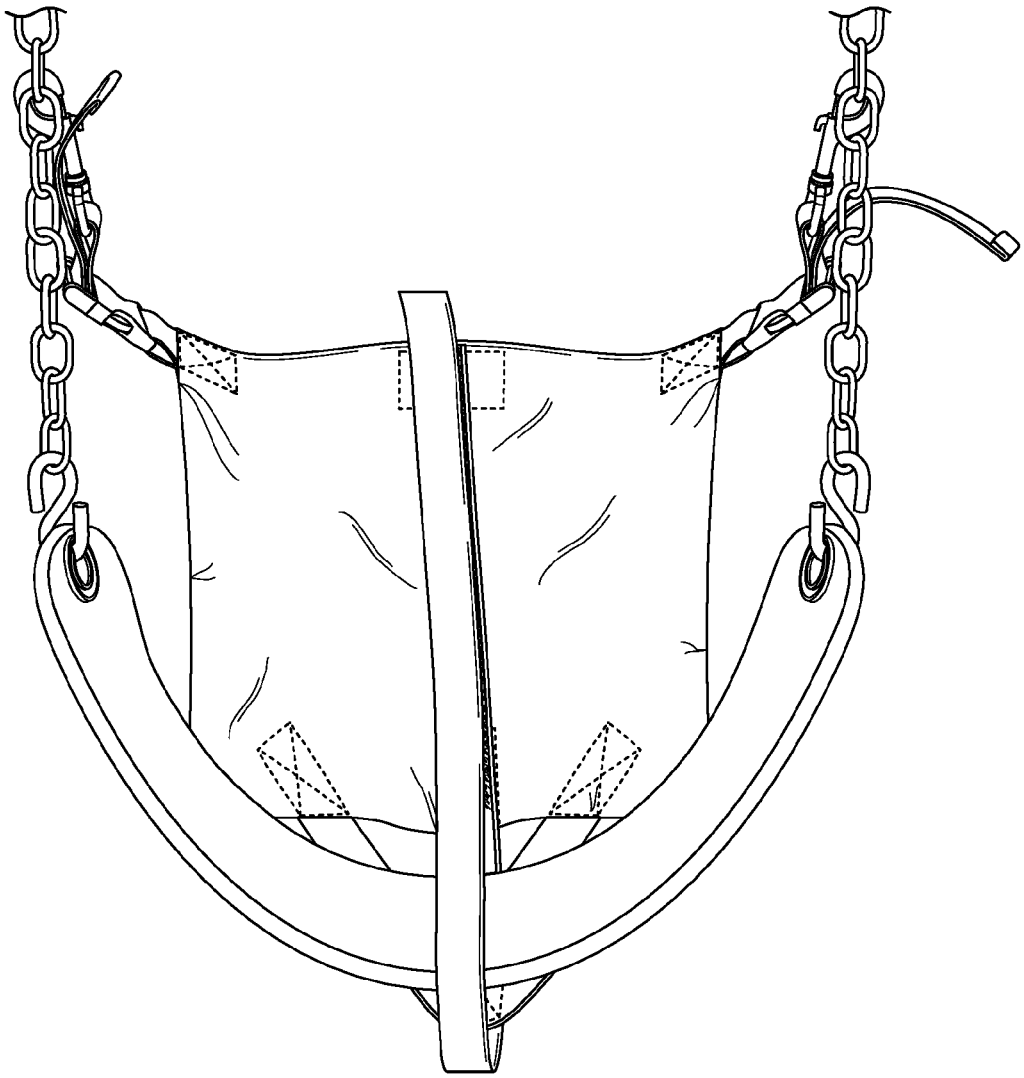
FIG. 4 is a front view of the attachment for a playground swing attached to the playground swing.
Figure 5:
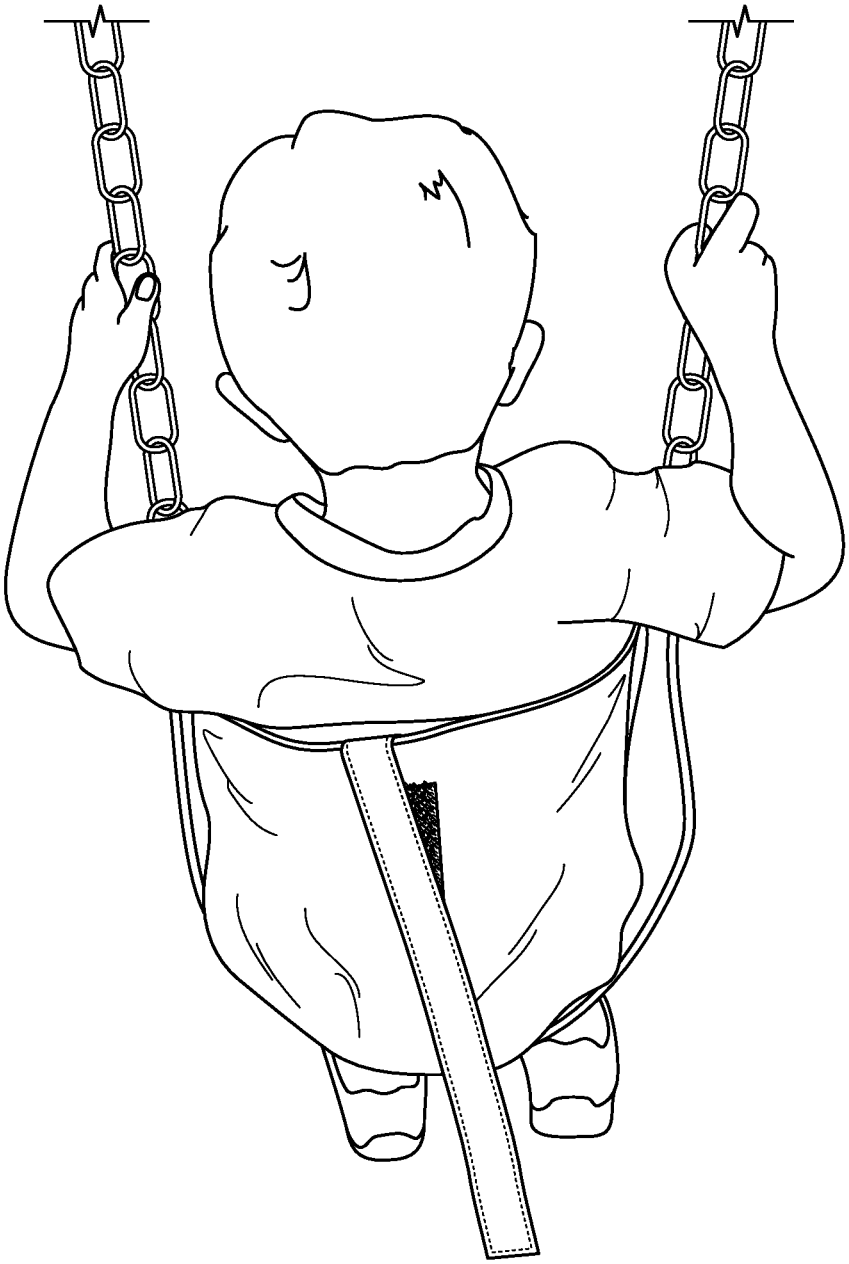
FIG. 5 is a back view of a child seated on a playground swing having the attachment for the playground swing attached thereto (e.g. SwingSafe™ device).

FIG. 4 is a front view of the attachment for a playground swing attached to the playground swing. As shown in FIG. 4, the center strap is attached at a first end to the back support. In FIG. 4, the bottom (second) end of the center strap furthest from the back support fabric has Hook and Loop Tape sewn securely to it with the corresponding Hook and Loop Tape piece then sewn up the middle of the back support fabric so that it can wrap around the swing and stick back to itself. In FIG. 4, the Hook and Loop Tape is sewn onto the front (seating) side of the back support.

Also shown in FIGS. 3 and 4 are removable metal clips or carabiner at the ends of the left and right adjustable straps. They are placed through grommets and clipped onto the chains of the existing swing.

With respect to the fabric used for the back support, any number of strong fabric types could be used. For example, two 8" by 12" fleece pieces may be sewn together but material made to withstand elements could be used in the case that it would likely stay attached to someone's personal swing. The fabric used in FIG. 1 was cut into a 8" by 12" rectangle; however different dimensions could be used as long as the back support fabric fits the chains of a standard swing.

Grommets may be fastened securely on each top corner of the back support fabric. Many different kind of secure fasteners could be used as long as they are secure and strong enough.

Many different kinds of strap material could be used as long as the material is strong enough. As shown in FIG. 3, two pieces of equal length are sewn securely on either end of the bottom of the back support fabric, and then sewn securely to a single much longer piece of strap material (i.e., the center strap) that is sewn on one end to the fabric at equal distance between the first and second straps. There are a several different ways you could attach the straps in order to provide adequate support and not allowing for a large enough space for a child to slip through.

With respect to the center strap, the bottom end furthest from the back support fabric has Hook and Loop Tape sewn securely to the front side of it with the corresponding Hook and Loop Tape piece then sewn up the middle of the back support fabric so that it can wrap around the swing and stick back to itself.

In one embodiment, two removable metal clips or carabiner are placed through grommets and clipped onto the chains of the existing swing. Several different kinds of clips or carabiners could be used as long as they are made of strong material and they are thin enough to attach onto the chains of the existing swing.

FIG. 6A is a top view of an embodiment of the attachment for a playground swing showing metal clips, strap adjusters, a fabric back support and a center strap comprising Velcro.

FIG. 6B is a back view of the attachment for a playground is a back view of the attachment for a playground swing wherein the left and right adjustable straps have been attached to corresponding left and right playground swing chains.

FIG. 6C is a back view of the attachment for a playground is a back view of the attachment for a playground swing wherein the left and right adjustable straps have been attached to corresponding left and right playground swing chains and the center strap has been looped around the playground swing seat.

FIG. 6D is a side view of the attachment for a playground is a back view of the attachment for a playground swing wherein the left and right adjustable straps have been attached to corresponding left and right playground swing chains, and the center strap has been looped around the playground swing seat.

Figure 7:
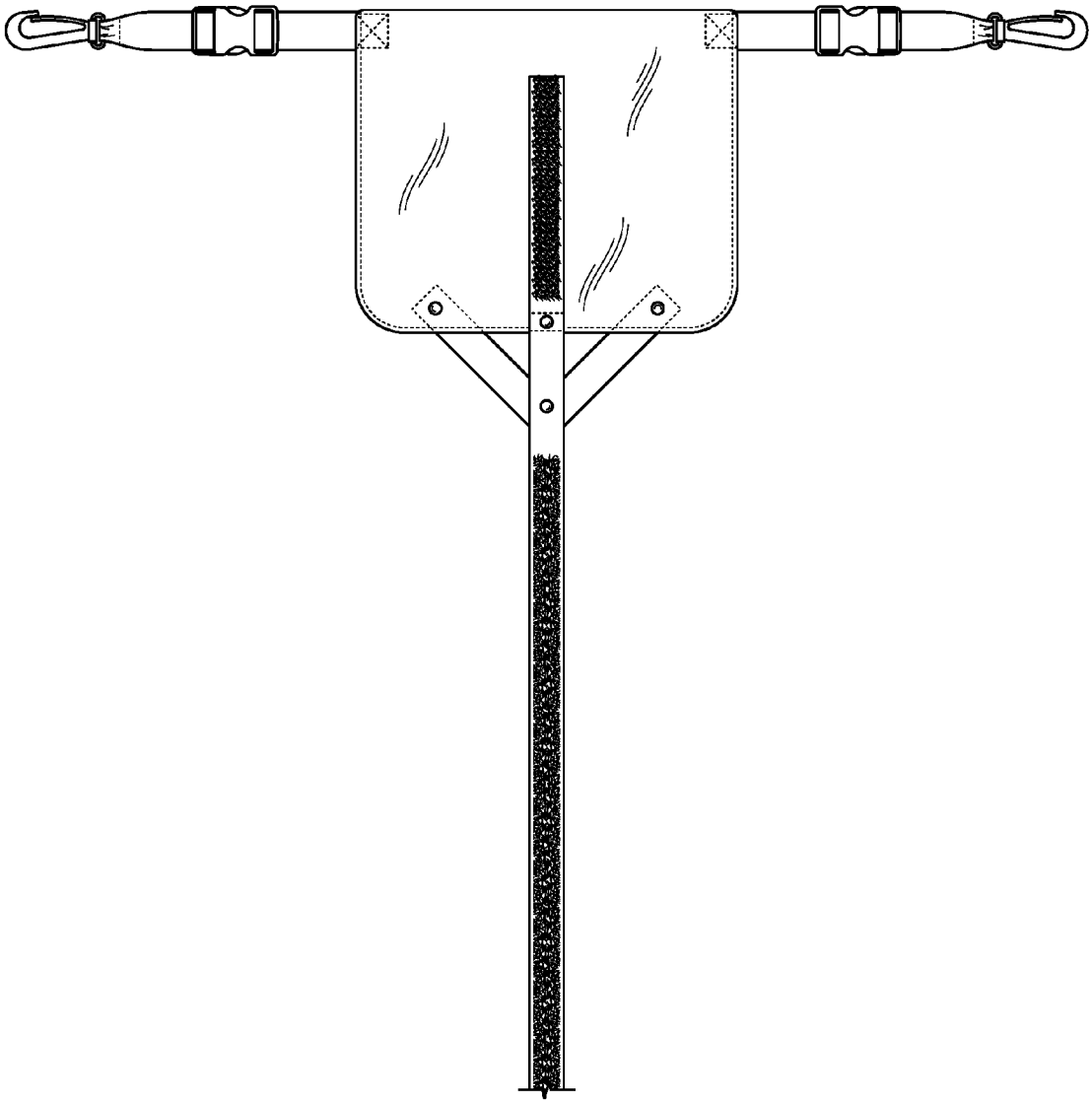
FIG. 7 is a back view of an embodiment of an attachment for a playground swing seat in accordance with the present invention.

FIG. 7 is a back view of an embodiment of an attachment for a playground swing seat in accordance with the present invention wherein both ends of the center strap comprise Velcro attachments.

Figure 8:
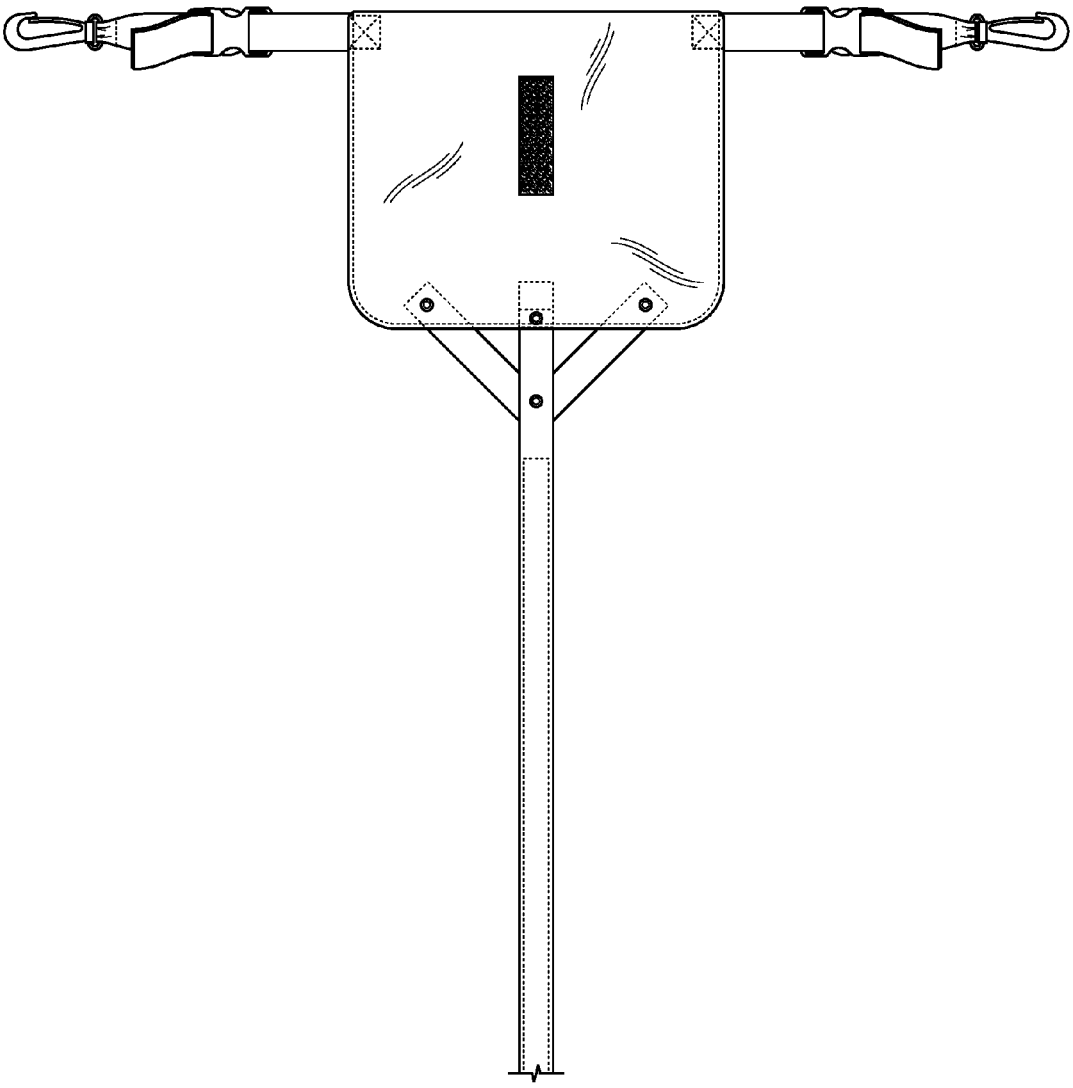
FIG. 8 is a back view of an embodiment of an attachment for a playground swing seat in accordance with the present invention.

FIG. 8 is a back view of an embodiment of an attachment for a playground swing seat in accordance with the present invention wherein a Velcro attachment for the center strap is arranged on the back support instead of on both ends of the center strap.

How to Use the Invention

This invention would fasten to each of the two chains on a swing that does not have back support then the bottom strap wraps underneath the swing and attaches back to itself. When the child sits on the swing they will be sitting on the strap reinforcing the strap to stay with their body weight. The child would then swing on the swing having their back supported. Once they are done using the swing it would be unfastened and taken with the owner. The invention could also be made with material intended to be left outside and withstand the elements so someone could use it for their personal swing without having to take it off each time.

One embodiment of the invention is depicted in FIG. 6A. Therein, the device of the invention (alternatively referred to as "SwingSafe™" herein) appears with parts A-D labeled. The device is attached to a swing as follows:

Unfold SwingSafe™ so that the Metal Clips (A) are on top and the Velcro Strap (D) is hanging down. Fasten the Metal Clips (A) to the Swing's chains so that the bottom of the Fabric Back (C) reaches down past the top of the Swing Seat. Make sure the Metal Clips (A) are attached to the eye of the chain, so they are secured and will not slip. Adjust the Strap Lengths (B) as needed. (See FIG. 6B).

The long Velcro Strap (D) should hang down behind the Swing seat. (See FIG. 6C).

Take the Velcro Strap (D) and run it down underneath the Swing Set, then up over the top of the Swing Seat so the Strap fastens to the Velcro in the front of the Fabric (See FIG. 6D). Excess strap can loop over the back of the fabric and be attached to the Velcro on the Back. The child will sit on top of the strap.

Instructions for Care: Wash the SwingSafe™ by Hand or on Gentle Cycle in Cold Water. If there is a stain, treat it with one of today's stain treatments. Do not use Bleach, Rinse well and dry.

What is claimed is:

1. A playground swing assembly for a child, comprising a pair of playground swing chains to which a swing seat is attached, a back support adapted to fit between the pair of playground swing chains, the back support being made of a fabric material, the back support having a front side and a back side, and the back support having an upper area comprising a right upper quadrant and a left upper quadrant and an upper center quadrant, and a lower area comprising a lower left quadrant, a lower right quadrant, and a lower center quadrant;

a left adjustable strap having a proximal end attached to the left upper quadrant of the back support, the left adjustable strap having a distal end which has a fastener attaching the left adjustable strap to one of the playground swing chains;

a right adjustable strap having a proximal end attached to the right upper quadrant of the back support, the right adjustable strap having a distal end which has a fastener attaching the left adjustable strap to the other playground swing chain;

a center strap having a first end attached to the back side of the center quadrant of the back support, the center strap having a second end having a fastener for attaching the second end of the center strap to the back support;

the attachment being configured such that the left and right adjustable straps are removably attached to respective playground swing chains, and the center strap is wrapped under the swing seat and around the top of the swing seat and the second end of the center strap is attached to the first end of the center strap, such that when in use the back support supports the back of a child seated on the swing seat and the child sits on the center strap, such that the strap does not attach to the child and allows the child to get off the swing unassisted and the attachment does not restrain the child onto the swing seat, a left lower strap attached at a first end to the lower left quadrant of the back support, the left lower strap having a second end attached to the center strap; and a right lower strap attached at a first end to the lower right quadrant of the back support, the right lower strap having a second end attached to the center strap at the same location as the attachment of the left lower strap, the right and left lower straps being of equal length and attached to the back support at equal distances from the center strap.

2. The playground swing assembly of claim 1, wherein the back support is machine washable.

3. The playground swing assembly of claim 1, wherein the center strap is comprised of hook and loop tape.

4. The playground swing assembly of claim 1, wherein the back support is a rectangle measuring about 8 inches by about 12 inches.

5. The playground swing assembly of claim 1, wherein the fasteners on the left and right adjustable straps are metal clips.

6. The playground swing assembly of claim 1, wherein the fasteners on the left and right adjustable straps are carabiners.

7. An attachment for a swing that does not have back support for a child, comprising a back support adapted to fit between a pair of playground swing chains to which a swing seat is attached, the back support being made of a fabric material, the back support being planar and having a front side and a back side, and the back support having an upper area comprising a right upper quadrant and a left upper quadrant and an upper center quadrant, and a lower area comprising a lower left quadrant, a lower right quadrant, and a lower center quadrant;

a left adjustable strap having a proximal end attached to the left upper quadrant of the back support, the left adjustable strap having a distal end which has a fastener for attaching the left adjustable strap to a playground swing chain;

a right adjustable strap having a proximal end attached to the right upper quadrant of the back support, the right adjustable strap having a distal end which has a fastener for attaching the left adjustable strap to a playground swing chain;

a center strap having a first end attached to the back side of the center quadrant of the back support, the center strap having a second end having a fastener for attaching the second end of the center strap to the back support;

the attachment being configured such that in use the left and right adjustable straps are removably attached to respective playground swing chains, and the center strap can be wrapped under the swing seat and around the top of the swing seat and the second end of the center strap is attached to the back support, such that when in use the back support supports the back of a child seated on the swing seat and the child sits on the center strap, and such that the strap does not attach to the child and allows the child to get off the swing unassisted, and wherein the first end of the center strap comprises a fastener which is attached to the back support, and the fastener on the second end of the center strap can be attached to the first end of the center strap.

8. The attachment for a swing of claim 7, further comprising a left lower strap attached at a first end to the lower left quadrant of the back support, the left lower strap having a second end attached to the center strap;

a right lower strap attached at a first end to the lower right quadrant of the back support, the right lower strap having a second end attached to the center strap at the same location as the attachment of the left lower strap, the right and left lower straps being of equal length and attached to the back support at equal distances from the center strap.

9. The attachment for a swing of claim 7, wherein the back support comprises a fastener for fastening the second end of the center strap to the back support.

10. The attachment for a swing of claim 7, wherein the back support is lightweight and washable.

11. The attachment for a swing of claim 10, wherein the fasteners on the left and right adjustable straps are metal clips.

12. The attachment for a swing of claim 10, wherein the fasteners on the left and right adjustable straps are carabiners.

13. The attachment for a swing of claim 10, wherein the center strap is comprised of hook and loop tape.

14. The attachment for a swing of claim 13, wherein the back support is a rectangle measuring about 8 inches by about 12 inches.

15. A method of providing back support to a playground swing for a child that does not provide back support, comprising providing an attachment for a playground swing comprising a back support adapted to fit between a pair of playground swing chains to which a swing seat is attached, the back support being made of a fabric material, the back support having a front side and a back side, and the back support having an upper area comprising a right upper quadrant and a left upper quadrant and an upper center quadrant, and a lower area comprising a lower left quadrant, a lower right quadrant, and a lower center quadrant; a left adjustable strap having a proximal end attached to the left upper quadrant of the back support, the left adjustable strap having a distal end which has a fastener for attaching the left adjustable strap to a playground swing chain; a right adjustable strap having a proximal end attached to the right upper quadrant of the back support, the right adjustable strap having a distal end which has a fastener for attaching the left adjustable strap to a playground swing chain; a center strap having a first end attached to the back side of the center quadrant of the back support, the center strap having a second end having a fastener for attaching the second end of the center strap to the back support;

attaching the left adjustable strap to one of the playground swing chains;

attaching the right adjustable strap to the other playground swing chain; and wrapping the center strap under the swing seat and around the top of the swing seat and then attaching the second end of the center strap to the first end of the center strap, such that when in use the back support supports the back of a child seated on the swing seat and the child sits on the center strap, such that the strap does not attach to the child and allows the child to get off the swing unassisted, wherein the attachment further comprises a left lower strap attached at a first end to the lower left quadrant of the back support, the left lower strap having a second end attached to the center strap; and a right lower strap attached at a first end to the lower right quadrant of the back support, the right lower strap having a second end attached to the center strap at the same location as the attachment of the left lower strap, the right and left lower straps being of equal length and attached to the back support at equal distances from the center strap.

* * * * *